US012653278B2

(12) United States Patent
Oddou et al.

(10) Patent No.: US 12,653,278 B2
(45) Date of Patent: Jun. 16, 2026

(54) ADJUSTABLE LENGTH CRAMPON

(71) Applicant: BLUE ICE Europe, Les Houches (FR)

(72) Inventors: Paul Oddou, Les Houches (FR); Jean-Manuel Ibarra, Les Houches (FR)

(73) Assignee: BLUE ICE Europe, Les Houches (FR)

( * ) Notice: Subject to any disclaimer, the term of this patent is extended or adjusted under 35 U.S.C. 154(b) by 0 days.

(21) Appl. No.: 19/210,587

(22) Filed: May 16, 2025

(65) Prior Publication Data

US 2025/0351924 A1 Nov. 20, 2025

(30) Foreign Application Priority Data

May 17, 2024 (FR) ..... 24/05111

(51) Int. Cl.
*A43C 15/06* (2006.01)

(52) U.S. Cl.
CPC ..... *A43C 15/063* (2013.01); *A43C 15/065* (2013.01); *A43C 15/066* (2013.01)

(58) Field of Classification Search
CPC ..... A43B 3/16; A43C 15/068; A43C 15/061; A43C 15/06; A43C 15/063; A43C 15/066; A63C 13/001; A63C 13/005
See application file for complete search history.

(56) References Cited

U.S. PATENT DOCUMENTS

| | | | | |
|---|---|---|---|---|
| 3,229,389 A | 1/1966 | Adams | | |
| 3,685,173 A * | 8/1972 | Piazza | A43C 15/068 | 36/64 |
| 4,338,733 A * | 7/1982 | Frechin | A43C 15/068 | 36/135 |
| 6,766,597 B1 * | 7/2004 | Perrod | A43C 15/068 | 36/97 |

(Continued)

FOREIGN PATENT DOCUMENTS

| | | |
|---|---|---|
| DE | 3438688 | 4/1986 |
| DE | 9306391 | 8/1993 |

(Continued)

OTHER PUBLICATIONS

Search Report and Written Opinion issued in corresponding FR Application 2405111, dated Dec. 10, 2024, and an English Translation (machine), 9 pages.

(Continued)

*Primary Examiner* — Khoa D Huynh
*Assistant Examiner* — Erick I Lopez
(74) *Attorney, Agent, or Firm* — Burris Law, PLLC

(57) ABSTRACT

The length-adjustable crampon for a shoe includes a connecting element, a first part and a second part connected by the connecting element. The crampon includes means for setting the length of the crampon and a locking device configured to maintain the length setting of the crampon. The crampon is configured so that, when the locking device is in an unlocking configuration, a force exerted on the (Continued)

crampon induces an automatic transition from a coupling configuration of the setting means with the connecting element, ensuring the length setting of the crampon, to an uncoupling configuration of the setting means relative to the connecting element, the force being exerted to adjust the length setting of the crampon by reducing the length of the crampon.

14 Claims, 9 Drawing Sheets

(56) References Cited

U.S. PATENT DOCUMENTS

2002/0095820 A1* 7/2002 Giovale ..... A43C 15/061
36/62

FOREIGN PATENT DOCUMENTS

| | | |
|---|---|---|
| DE | 9312977 | 11/1993 |
| DE | 20200954 | 6/2002 |
| EP | 1348350 | 10/2003 |
| EP | 2633773 | 9/2013 |
| FR | 2555872 | 6/1985 |
| FR | 2763859 | 12/1998 |
| IT | MI20100182 | 8/2011 |
| KR | 100885806 | 2/2009 |

OTHER PUBLICATIONS

PETZL, Dart, Technical Notice, 14 pages, PETZL Foundation.

* cited by examiner

ADJUSTABLE LENGTH CRAMPON

TECHNICAL FIELD OF THE INVENTION

The invention concerns the field of crampons, notably for mountaineering. More particularly, the invention relates to a length-adjustable crampon for a shoe.

PRIOR ART

Known from the prior art is a crampon for a shoe, notably of the ice crampon type for mountaineering, comprising a front frame and a back frame connected to each other by an elongated connecting bar comprising holes staggered along the length of the connecting bar. The crampon comprises setting means for setting the length of the crampon. The setting means comprise a stud intended to be inserted into one of the holes of the connecting bar and a flexible tab secured to the back frame. The stud is arranged at one end of the tab, the length setting of the crampon being ensured by cooperation between the connecting bar and the stud when the stud is inserted into one of the holes of the connecting bar.

The setting means comprise gripping means, making it possible to lift one end of the tab and extract the stud from the hole in order to adjust/change the length setting of the crampon. When setting the crampon length, the gripping means may be difficult to grasp, notably when the user of the crampon is wearing gloves.

The patent application EP 1 348 350 A1 describes such a crampon.

There is a need to make setting the length of the crampon easier.

OBJECT OF THE INVENTION

The present invention aims to facilitate the adjustment of the length setting of a crampon.

To this end, the invention relates to a length-adjustable crampon for a shoe, said crampon comprising:

- a first part comprising a frame;
- a second part;
- an elongated connecting element connecting the first and second parts, the first part and the connecting element being configured to have relative to each other an ability to move along the length of the connecting element to allow adjustment of the length setting of the crampon;
- setting means configured to selectively adopt:
  - a coupling configuration with the connecting element ensuring the length setting of the crampon;
  - an uncoupling configuration relative to the connecting element in which the ability to move is authorized in order to ensure the adjustment;
- a locking device configured to selectively adopt:
  - a locking configuration in which, when the setting means are in the coupling configuration, the locking device prevents the transition from the coupling configuration to the uncoupling configuration to maintain the length setting of the crampon;
  - an unlocking configuration in which the variation between the coupling configuration and the uncoupling configuration is authorized.

The crampon is configured so that, when the locking device is in its unlocking configuration and the setting means are in the coupling configuration, a force exerted on the crampon induces an automatic transition from the coupling configuration to the uncoupling configuration, said force being exerted on the crampon to obtain a relative displacement between the first part and the connecting element according to the ability to move in order to adjust the length setting of the crampon by reducing the length of the crampon.

Such a crampon has the advantage of allowing easier setting/adjustment of the length of the crampon. Indeed, this avoids having to manually lift the tab many times as in the prior art to adjust the length setting of the crampon by trial and error: notably, an adjustment obtained by moving the first part towards the second part is simpler as long as the locking device has been made inactive by placing it in its unlocking configuration. This further allows easier setting, for example when the user is wearing gloves. Furthermore, according to one use case, this allows rapid setting of the crampon to the shoe by positioning the shoe on the crampon in abutment against the second part; it is then sufficient, while the locking device is in its unlocking configuration, for the user to move the first part towards the second part until a suitable setting of the length is reached, for example by placing the first part in abutment against the shoe or at the last possibility of coupling between the setting means and the connecting element before the first part abuts against the shoe.

The crampon may further comprise one or several of the following features.

According to a feature of the crampon, one of the first and second parts is a front part intended to receive the front of a sole of the shoe, and the other of the first and second parts is a back part intended to receive the back of the sole of the shoe.

This makes it possible to adjust the setting of the length of the crampon by acting either on the front part or on the back part.

According to a feature of the crampon, the setting means comprise a stud, and the connecting element comprises setting holes staggered along the length of the connecting element and each configured to receive the stud, the coupling configuration being implemented when the stud is inserted into any of the setting holes.

This allows an incremental adjustment of the length of the crampon, for example this incremental adjustment is such that this allows between two increments (i.e. between two adjacent setting holes) an adjustment by a value less than or equal to the absolute value of the difference in sole length of the shoe between two consecutive shoe sizes.

According to a feature of the crampon, the stud comprises a sliding surface configured to, when the locking device is in the unlocking configuration and the setting means are in the coupling configuration, slide on the connecting element when said force is exerted in order to make it possible to extract the stud from the setting hole in which it is inserted, resulting in the transition from the coupling configuration to the uncoupling configuration.

This makes it possible to accompany the transition from the coupling configuration to the uncoupling configuration in order to adjust the length setting of the crampon without manual action on the setting means as the force exerted on the crampon, notably bringing the first part closer to the second part, to adjust the length setting of the crampon is sufficient to induce an automatic exit of the stud from a corresponding setting hole in which it is inserted.

According to a feature of the crampon, the sliding surface is a flat oblique face and each setting hole comprises an edge comprising, on the side of the second part, a straight portion capable of cooperating with the oblique face.

This makes it possible to provide suitable sliding of the stud on the connecting element when bringing closer the first part and the second part and to adapt to the morphology of the stud to limit the functional play between the first part and the connecting element in the coupling configuration.

According to a feature of the crampon, the setting means comprise a body secured to the frame of the first part, the body having, in the coupling configuration, an original state and being configured to, in the unlocking configuration of the locking device:

- have an elastic deformation when transitioning from the coupling configuration to the uncoupling configuration;
- transition, by automatic return to the original state, from the uncoupling configuration to the coupling configuration.

The elastic deformation allows, when said force exerted on the crampon is applied to reduce the length of the crampon, a variation between the coupling configuration and the uncoupling configuration without having to apply a manual force directly on the body while allowing, if necessary, an automatic return to the coupling configuration.

According to a feature of the crampon, the body is configured so as to, during the relative displacement between the first part and the connecting element having induced the automatic transition from the coupling configuration to the uncoupling configuration, allow an automatic transition from the uncoupling configuration to the coupling configuration, from which it results that the length setting of the newly obtained crampon corresponds to a reduction in the length of the crampon.

This is notably obtained thanks to the elastic deformation of the body obtained during the transition from the coupling configuration to the uncoupling configuration.

According to a feature of the crampon, the locking device comprises a locking element having a mobility ability relative to the frame and the setting means, said locking element is configured to vary, according to its mobility ability, between:

- a first configuration in which, in the coupling configuration, the locking element opposes the transition from the coupling configuration to the uncoupling configuration;
- a second configuration in which the transition from the coupling configuration to the uncoupling configuration is authorized.

This mobility ability allows for circumstantial handling of the locking element in order to authorize or inhibit the automatic transition from the coupling configuration to the uncoupling configuration.

According to a feature of the crampon, when the locking element is in the first configuration and the setting means are in the coupling configuration, the locking element cooperates with the connecting element to hold the setting means so as to oppose the transition from the coupling configuration to the uncoupling configuration.

This makes it possible to ensure, if necessary, that the locking device is held in its locking configuration by maintaining the position of the setting means relative to the connecting element with which they are coupled.

According to a feature of the crampon, the body is linked to the frame of the first part at a linking region; the locking element is a ring crossed by the body and slidably mounted relative to the body; in the first configuration of the locking element, while the setting means are in the coupling configuration, the ring surrounds a part of the connecting element in order to prevent a separation of at least one part of the body relative to the connecting element allowing the transition from the coupling configuration to the uncoupling configuration; in the second configuration of the locking element, the ring does not oppose the elastic deformation of the body allowing the transition from the coupling configuration to the uncoupling configuration.

This makes it possible to allow, by positioning the ring in the second position, the desired elastic deformation of the body, making it possible to adjust the setting of the length of the crampon.

According to a feature of the crampon, the locking device comprises a blocking member configured to selectively adopt:

- a first configuration in which the blocking member opposes the transition of the locking element from its first configuration to its second configuration;
- a second configuration in which the blocking member authorizes the transition of the locking element from its first configuration to its second configuration.

When proper setting of the length of the crampon is obtained, this makes it possible to ensure that this setting is maintained.

According to a feature of the crampon, the blocking member is a spring leaf, and the second configuration of the blocking member corresponds to a compression state of the spring leaf.

Such a spring leaf has the advantage that a manual action on the latter is necessary to allow the variation of the locking element from its first configuration to its second configuration, thus avoiding an unwanted loss of setting. With such a spring leaf, the manual action can easily be carried out by a finger of the user even when wearing a glove, which is particularly suitable in the field of application of the crampon. Furthermore, the spring leaf has the advantage of naturally returning to its natural position when it is no longer biased (i.e. without manual action by the user on the spring leaf), thus allowing notably an automatic return to the first configuration of the blocking member.

According to a feature of the crampon, the spring leaf is configured to vary between a first state and a second state, the transition from the first state to the second state being accompanied by compression of the spring leaf; in the first configuration of the blocking member, while the locking element is in its first configuration, the leaf is in its first state and forms a stop opposing the transition of the locking element from its first configuration to its second configuration; the crampon is configured so that the transition of the locking element from its first configuration to its second configuration is authorized following the transition of the spring leaf from its first state to its second state, for example induced by a thrust force exerted on the spring leaf by a user of the crampon.

The aforementioned thrust force is easy to implement by a user even when wearing gloves. Furthermore, the spring leaf allows positive and automatic blocking of the locking element in the locking configuration.

According to a feature of the crampon, the frame of the first part comprises a cross member and at least one guide element extending from the cross member, the connecting element cooperating with said at least one guide element so as to guide the ability to move.

This makes it possible to help the user by conditioning the bringing of the first part closer to the second part.

According to a feature of the crampon, the crampon comprises a length setting configuration in which the connecting element and the second part are coupled:

- so as to have relative to each other a degree of freedom along the connecting element strictly less than a value of the relative displacement between the first part and the connecting element during a variation of the length setting of the crampon between two adjacent setting positions along the connecting element; or so that any relative movement between the connecting element and the second part in a direction along the length of the connecting element is prevented.

This allows efficient adjustment of the length of the crampon in the sense that the user will then only have to handle the crampon at the first part.

Other advantages and features may emerge from the following detailed description.

BRIEF DESCRIPTION OF THE DRAWINGS

The invention will be better understood upon reading the following detailed description, given solely as a non-limiting example and made with reference to the drawings appended and listed below.

In these figures, the same references are used to designate the same elements. The elements represented in the different figures are not necessarily drawn to scale in order to facilitate understanding of the figures.

DETAILED DESCRIPTION

Figure 1:
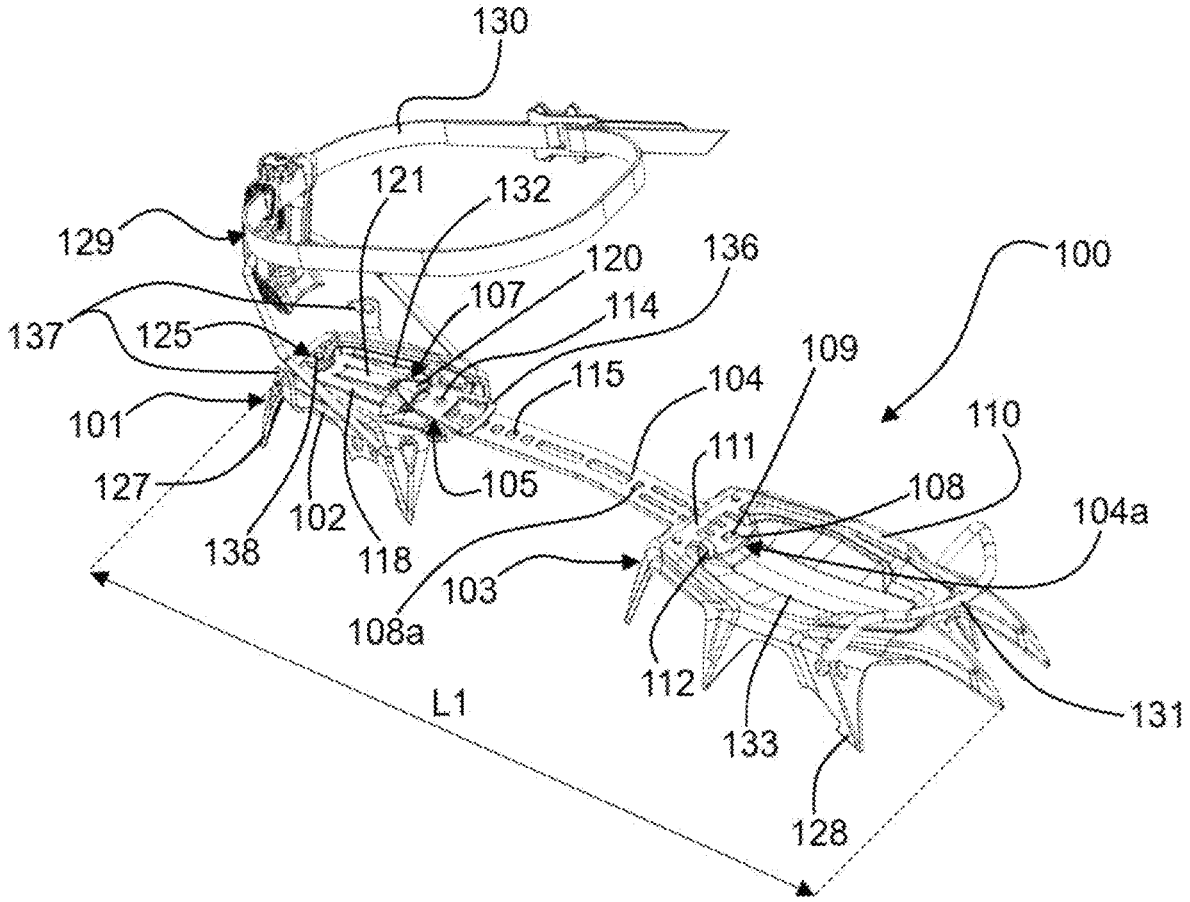
FIG. 1 represents, in a perspective view, a crampon according to a particular embodiment of the invention.

The invention relates to a length-adjustable crampon 100 for a shoe. A particular embodiment of this crampon 100, or parts of this crampon 100, is illustrated in FIGS. 1 to 15. In other words, the crampon 100 has a length setting that can be adjusted.

The, and notably each, length setting preferably corresponds to a set value of the length of the crampon 100 in a use configuration of the crampon 100, the adjustment of the length setting of the crampon 100 corresponds notably to the action exerted on the crampon 100 to modify the length setting of the crampon 100.

The crampon 100 is notably a crampon for mountain activities, also in this case called a mountaineering crampon. More particularly, the crampon 100 is an ice crampon.

The crampon 100 may comprise a lower side and an upper side opposite the lower side. The upper side is intended to receive the shoe. Thus, the lower side of the crampon 100 is notably defined opposite the location of the shoe on the crampon 100.

In the following description, the concepts of front and back are given in the reference system of the crampon 100, notably in relation to its use in cooperation with a shoe, the front of the crampon 100 being associated with (i.e. having to receive the) tip of the shoe at the toes of one of the feet of the person wearing the shoe and the back of the crampon 100 being associated with (i.e. having to receive the) tip of the shoe at the heel of said one of the feet.

The crampon 100 comprises a first part 101 comprising a frame 102 and a second part 103.

For example, one of the first and second parts 101, 103 is a front part intended to receive the front of a sole of the shoe, and the other of the first and second parts 101, 103 is a back portion intended to receive the back of the sole of the shoe.

Figure 2:
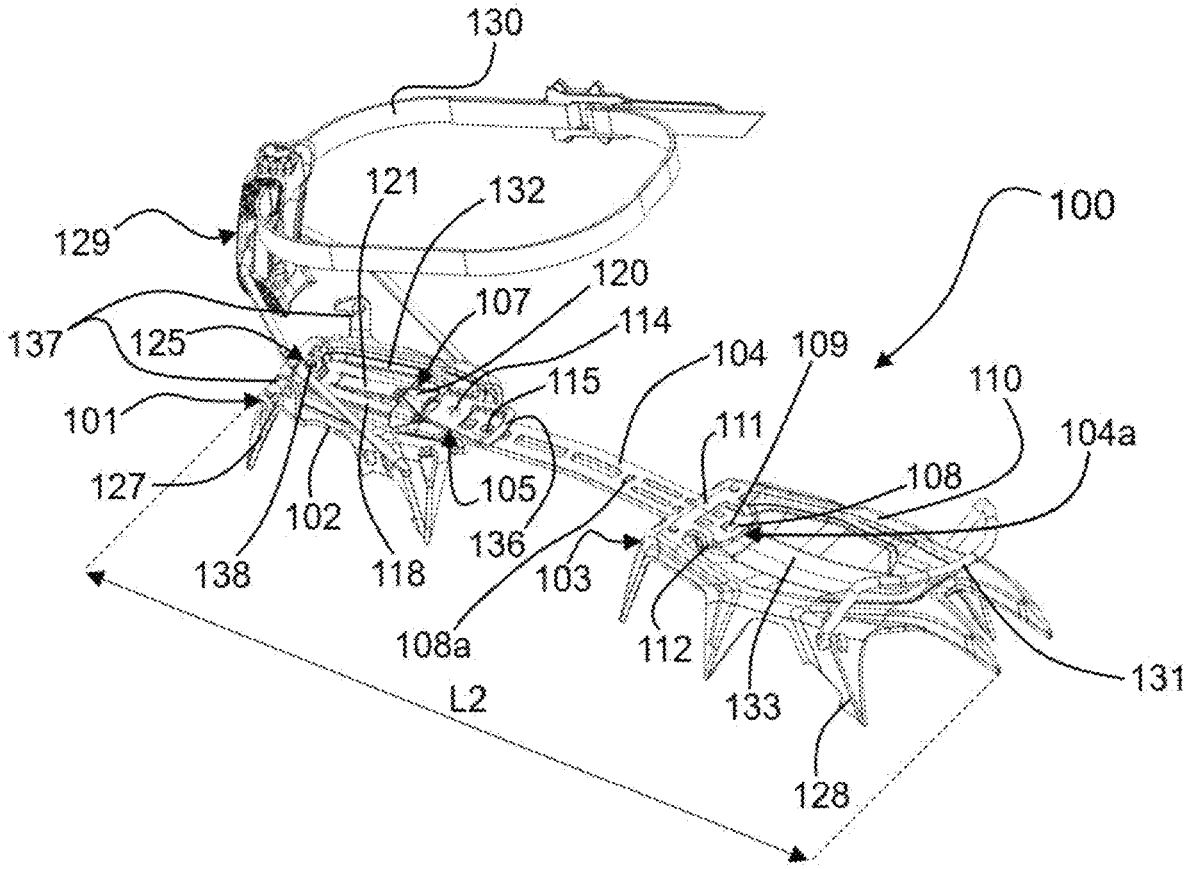
FIG. 2 represents, in a perspective view, the crampon of FIG. 1 which has been shortened in length.
Figure 3:
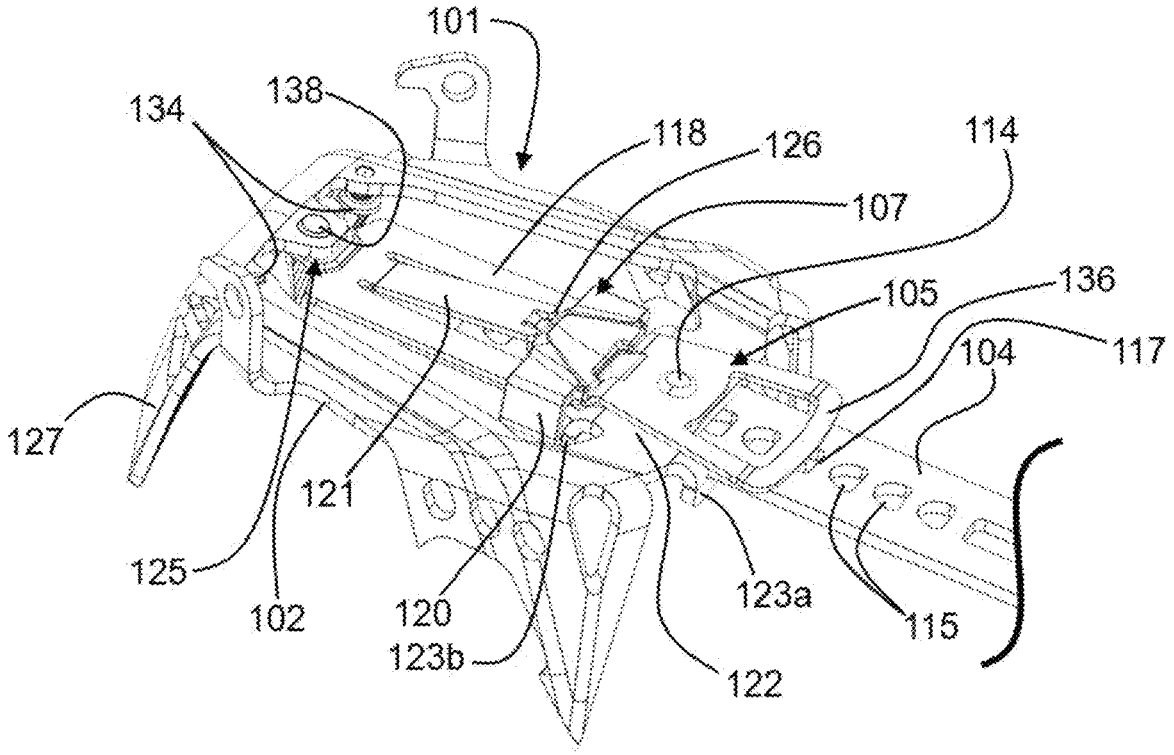
FIG. 3 represents, in a perspective view, a part of the crampon according to the invention centered on a back part of the crampon, seen from above and showing means for setting the crampon coupled to a connecting element of the crampon ensuring a given length setting of the crampon, these setting means being locked by a locking device belonging to the crampon.

In the context of the embodiment illustrated in FIGS. 1 and 2, and as visible in FIGS. 3 to 11 and 15, the first part 101 is intended/configured to receive the back of the sole of the shoe.

In the context of the embodiment illustrated in FIGS. 1 and 2, and as visible in FIGS. 12 to 15, the second part 103 is intended/configured to receive the front of the sole of the shoe.

The crampon 100 comprises an elongated connecting element 104 (for example as visible in FIGS. 1 to 15), also called a bar in the technical field of the present invention. This connecting element 104 connects the first and second parts 101, 103. Notably, the first and second parts 101, 103 are separated from each other by a longitudinal portion of the connecting element 104, and this notably regardless of the length setting of the crampon 100 for which the length of the longitudinal portion is of course suitable since this length of the longitudinal portion is dependent on the current length setting of the crampon 100.

Notably, the connecting element 104 comprises opposite longitudinal ends 104*a*, 104*b*.

The first part 101 and the connecting element 104 are configured to have relative to each other an ability to move along the length of (notably along) the connecting element 104 to allow an adjustment of the length setting of the crampon 100.

For example, sliding of the first part 101 along the connecting element 104 (in the direction of the length of the connecting element 104), or conversely sliding of the connecting element 104 along its length relative to the first part 101 makes it possible to modify/adjust the length of the crampon 100.

FIGS. 1 and 2 show, for example, two different settings of the same crampon 100 of length L1 and length L2 respectively, with length L1 strictly greater than length L2.

In order to ensure the length setting of the crampon 100, the crampon 100 comprises setting means 105 configured to selectively adopt:

- a coupling configuration with the connecting element 104 ensuring the length setting of the crampon 100, in other words the coupling configuration makes it possible, for example in the use configuration of the crampon 100, to ensure that the length of the crampon 100, i.e. its length setting, is retained;
- an uncoupling configuration relative to the connecting element 104 in which the ability to move is authorized in order to ensure the adjustment of the length setting of the crampon 100.

For example, FIGS. 1 to 9 and 15 illustrate the coupling configuration of the setting means 105.

Figure 10:
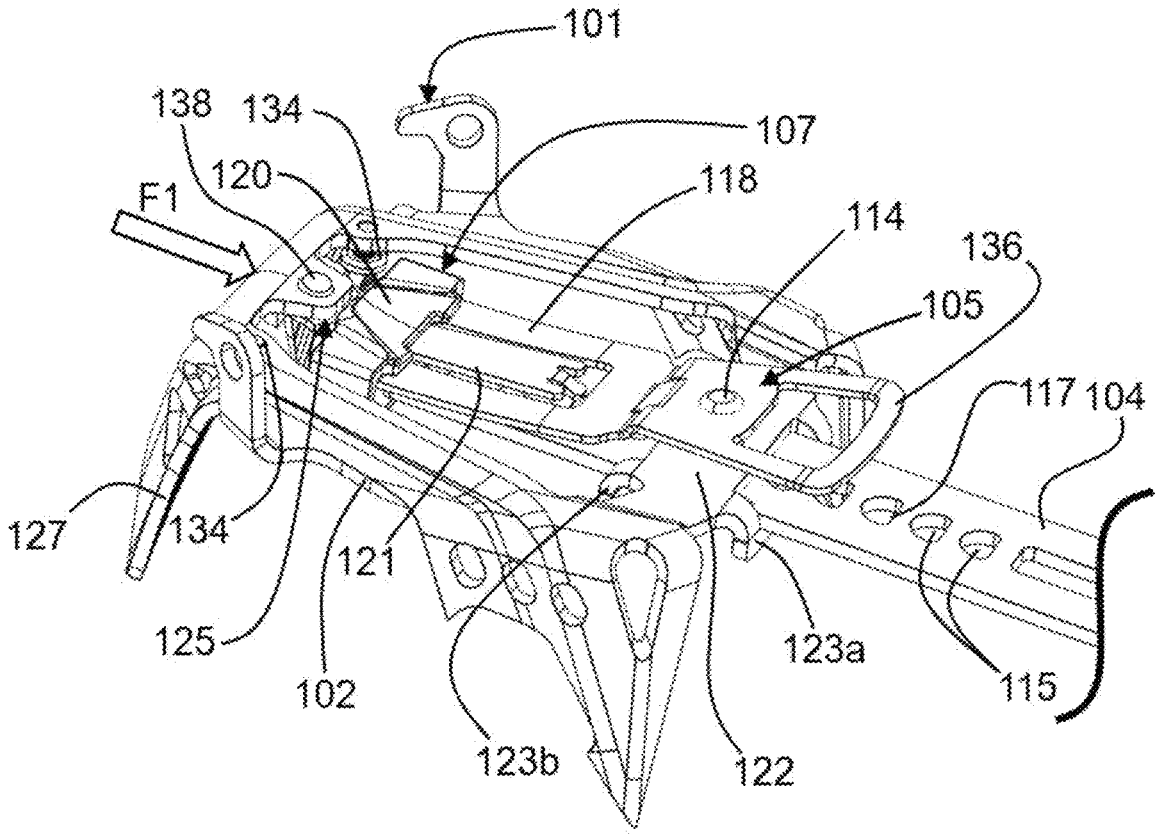
FIG. 10 represents, in a perspective view, the part of the crampon centered on the back part of the crampon for which an adjustment of the length setting of the crampon is in progress.
Figure 11:
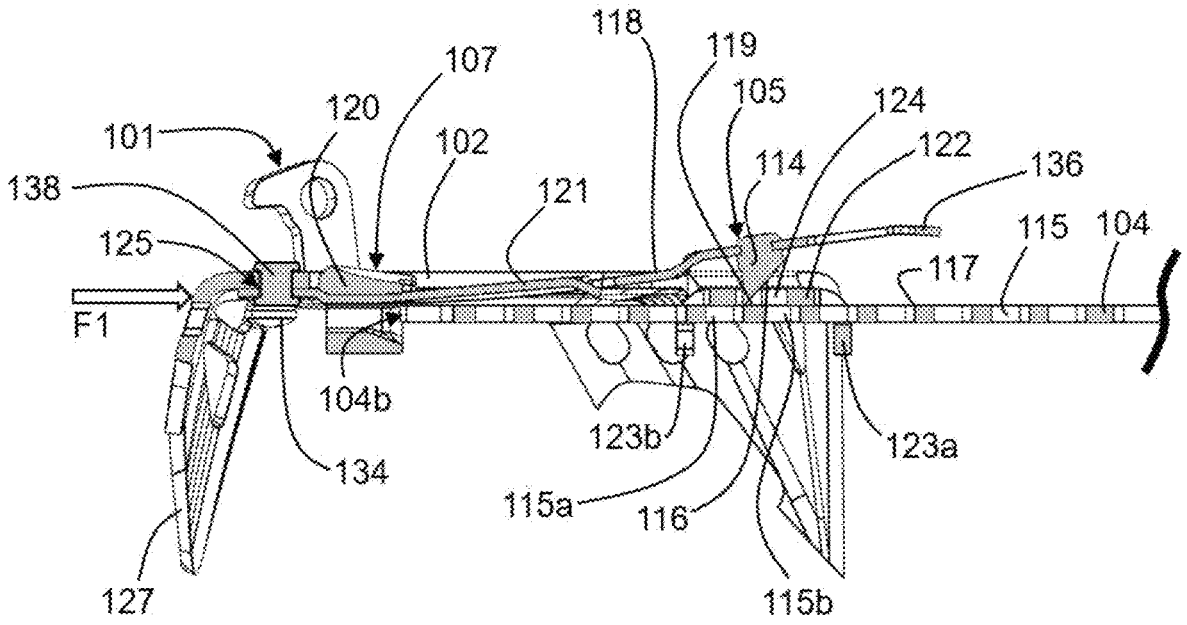
FIG. 11 represents, in a side sectional view, the part of the crampon of FIG. 10.
Figure 12:
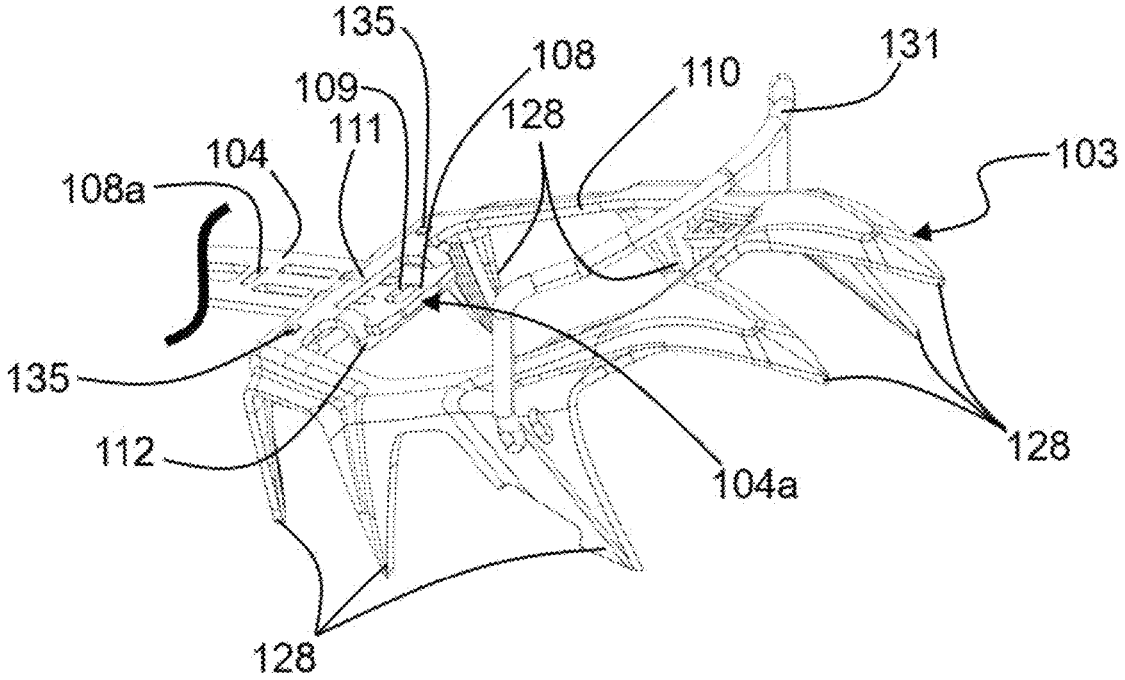
FIG. 12 represents, in a perspective view, another part of the crampon centered on the front part of the crampon and seen from above.

For example, FIGS. 10 and 11 illustrate the uncoupling configuration of the setting means 105.

By "adjusting the length setting of the crampon 100", it should be understood that the effective length of the crampon 100 can be adjusted according to different predetermined lengths (i.e. according to an adjustment range) making it possible to adapt to different user shoe sizes and shoe shapes. Thus, the coupling configuration of the setting means 105 can be implemented at different setting positions 106 along the connecting element 104. Each setting position 106 corresponds, when the setting means 105 are in the coupling configuration with the connecting element 104 at this setting position 106, to a given value of the length setting of the crampon 100 corresponding to a predetermined length of the crampon 100, notably in the use configuration.

Figure 5:
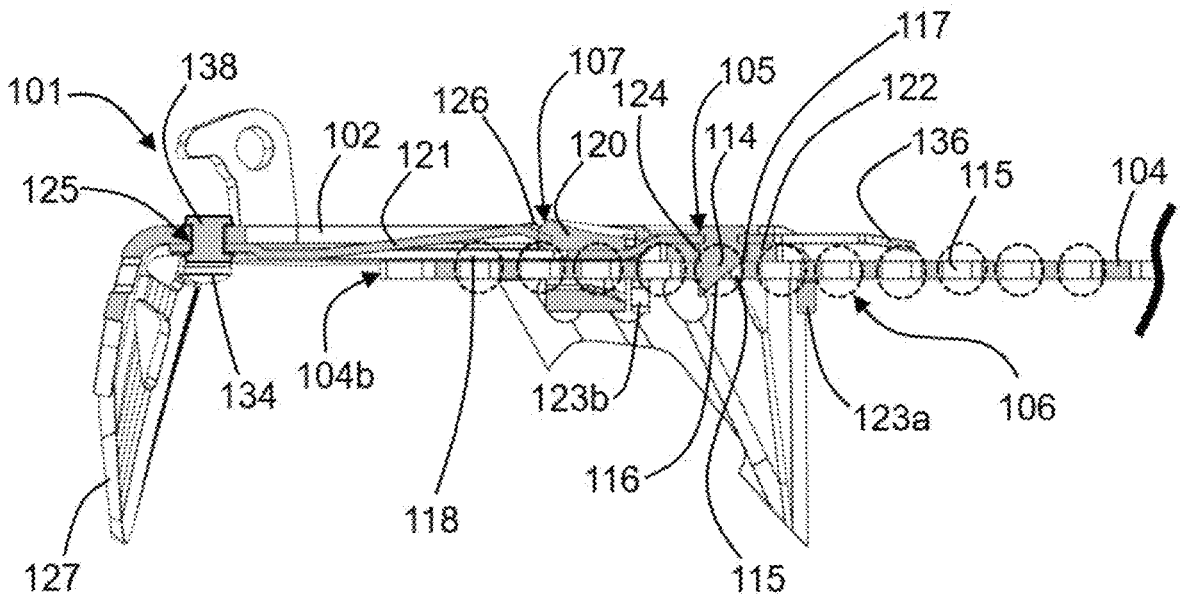
FIG. 5 represents, in a side sectional view, the part of the crampon of FIG. 3.

In the example illustrated in FIG. 5, it is possible to count eleven setting positions 106 (each represented by a dotted circle) each associated notably with a length value of the crampon 100 when the setting means 105 are coupled to said setting position 106. This number of eleven setting positions 106 is not limitative in the sense that the crampon 100 can comprise more or less, but at least two.

The crampon 100 comprises a locking device 107 configured to selectively adopt:

- a locking configuration in which, when the setting means 105 are in the coupling configuration, the locking device 107 prevents the transition from the coupling configuration of the setting means 105 to the uncoupling configuration of the setting means 105 to maintain the length setting of the crampon 100 (also called current length setting of the crampon 100);
- an unlocking configuration in which the variation between the coupling configuration of the setting means 105 and the uncoupling configuration of the setting means 105 is authorized.

Notably, FIGS. 1 to 7 and 15 each show the locking device 107 in its locking configuration.

Notably, FIGS. 8 to 11 each show the unlocking device 107 in its unlocking configuration.

In other words, in the locking configuration of the locking device 107 and when the setting means 105 are in the coupling configuration, the length setting of the crampon 100 is fixed, and in the unlocking configuration of the locking device 107 the length setting of the crampon 100 can be adjusted, notably by varying the relative position between the first part 101 and the connecting element 104.

In order to facilitate the adjustment of the length setting of the crampon 100, the crampon 100 is configured so that, when the locking device 107 is in its unlocking configuration and the setting means 105 are in the coupling configuration, a force F1 exerted on the crampon 100 (represented by an arrow F1 in FIGS. 8 to 11) induces an automatic transition from the coupling configuration of the setting means 105 to the uncoupling configuration of the setting means 105. This force F1 is exerted on the crampon 100 to obtain a relative displacement between the first part 101 and the connecting element 104 according to the ability to move in order to adjust the length setting of the crampon 100 by reducing the length of the crampon 100.

By "to obtain a relative displacement between the first part 101 and the connecting element 104 according to the ability to move in order to adjust the length setting of the crampon 100 by reducing the length of the crampon 100", it should be understood that there remains, before the force F1 is exerted, at least one achievable coupling configuration of the setting means 105, in particular at a setting position 106, in the context of a reduction in the length of the crampon 100.

The force F1 actually makes it possible to finally induce a bringing closer of the first part 101 and the second part 103.

This force F1 can be exerted indifferently:

- on the first part 101 (case represented in FIGS. 8 to 11) while the position of the connecting element 104 and/or the position of the second part 103 remain unchanged (i.e. the force F1 exerted on the first part 101 allows it to be brought closer to the second part 103 in order to induce an automatic transition from the coupling configuration of the setting means 105 to the uncoupling configuration of the setting means 105 to adjust the setting of the length of the crampon 100);
- on the connecting element 104 while the first part 101 is held; or
- on the second part 103, secured in movement to the connecting element 104, in a direction tending to bring the second part 103 closer to the first part 101.

This allows different scenarios for adjusting the length setting of the crampon 100.

According to one scenario for adjusting the length setting of the crampon 100, the crampon 100 has a length greater than the length that it must have for a given user. The user positions his shoe on the crampon 100, notably in abutment against the second part 103 which then forms the front part of the crampon 100. Then, the user exerts, while the locking device 107 is in the unlocking configuration, the force F1 on the first part 101 in a direction tending to bring the first part 101 closer to the second part 103 until obtaining the coupling configuration of the setting means 105 with the connecting element 104 adapted to the length of the shoe. Therefore, if necessary, one or several setting positions can be successively adopted before reaching the setting position 106 adapted to the shoe.

In this case, in order to carry out an adjustment of the adapted length setting of the crampon 100, it is appropriate to hold the connecting element 104 and the second part 103 together. This holding is notably ensured in the use configuration.

As mentioned above, it may be preferable for the second part 103 to be secured in movement to the connecting element 104. For this purpose, the crampon 100 may comprise a length setting configuration in which the connecting element 104 and the second part 103 are connected/coupled:

- so as to have relative to each other a degree of freedom along the connecting element 104 strictly less than a value of the relative displacement between the first part 101 and the connecting element 104 during a variation of the length setting of the crampon 100 between two adjacent setting positions 106 (i.e. associated with two consecutive length settings of the crampon 100) along the connecting element 104; or
- so that any relative movement between the connecting element 104 and the second part 103 in a direction along the length of the connecting element 104 is prevented.

In particular, FIGS. 1, 2, 12, 13 and 15 represent an exemplary embodiment with the possibility of implementing the degree of freedom in the sense that the connecting element 104 comprises, at its longitudinal end 104*a* opposite the first part 101, a first coupling member 108 and that the second part 103 comprises a second coupling member 109. The first and second coupling members 108, 109 are, in the setting configuration, connected by coupling to each other in order to limit the relative movement between the connecting element 104 and the second part 103.

According to a particular example, the degree of freedom is such that it makes it possible to refine the length of the crampon 100 (notably its predetermined length) by varying this length of the crampon 100 according to a functional play, for each length setting of the crampon 100, between a minimum reference length and a maximum reference length, the absolute value of the difference between the minimum reference length and the maximum reference length being between 3 millimeters and 10 millimeters, and preferably between 5 millimeters and 8 millimeters. This makes it possible to take into account the differences in shoe sizes depending on the country; for example, in France a shoe size increment used may be 5 millimeters while in the United Kingdom a shoe size increment used may be 3 millimeters.

By "between two values" it should be understood in the present description that these two values form the limits of a corresponding range for which both values are included.

In the configuration of use of the crampon 100 by the user, the first and second coupling members 108, 109 are of course coupled, then attaching the second part 103 to the connecting element 104.

For example, the first coupling member 108 is a through hole formed in the thickness of the connecting element 104 and the second coupling member 109 is a stud inserted, when the first and second coupling members 108, 109 are coupled, into the through hole forming the first coupling member 108.

The second part 103 may comprise a frame 110 comprising a cross member 111 arranged on the side of the first part 101. The second part 103 may comprise a support member 112 extending from the cross member 111 of the frame 110 of the second part 103 on the side internal to the frame 110 of the second part 103, for example in the manner of a stirrup. The second coupling member 109 then extends from the support member 112 in order to limit the degree of freedom when the connecting element 104 is supported by the support member 112 and the second coupling member 109 coupled to the first coupling member 108.

In order to provide guidance adapted according to the degree of freedom, the cross member 111 of the frame 110 of the second part 103 may comprise, at the outer periphery of the frame 110 of the second part 103, another support member 113 (FIG. 13), for example also taking the form of a stirrup.

Figure 14:
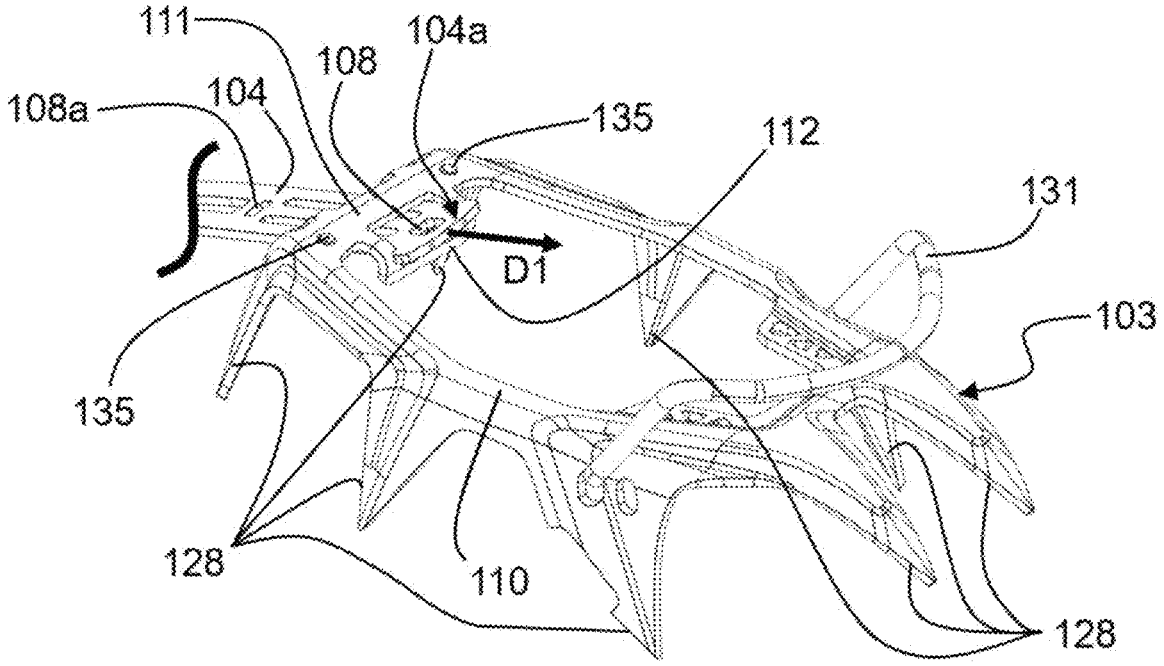
FIG. 14 represents, in a perspective view, the other part of the crampon in a state making it possible to shorten the crampon, for example, to be stored in a bag.

To satisfy a need for compact storage of the crampon 100, the first and second coupling members 108, 109 can be uncoupled, for example by tilting the connecting element 104 relative to the frame 110 of the second part 103 as shown for example in FIG. 14, which then makes it possible to move the longitudinal end 104*a* of the connecting element 104 comprising the first coupling member 108 forward (direction D1) of the second part 103 to suitably reduce the length of the crampon 100 in order to store it shortened, for example in a bag. Then, in order to re-couple the first and second coupling members 108, 109, it is sufficient to position them in the same region by relative sliding between the second part 103 and the connecting element 104 in a direction substantially parallel to the direction of measurement of the length of the connecting element 104, then to align the connecting element 104 and the frame 110 of the second part 103, for example in parallel planes.

By "substantially parallel" it should be understood parallel or parallel to within plus or minus 10 degrees.

In the case where it is desired to prevent any relative movement between the connecting element 104 and the second part 103 in a direction along the length of the connecting element 104, the connecting element 104 may be fastened to the second part 103 by any type of fastening means such as, for example, a weld, a bolt, a rivet, or a crimping.

It follows from what has been described above that there is a need to use an efficient solution for adjusting the length setting of the crampon 100. For this purpose, the setting means 105 preferably comprise a stud 114 (for example visible in FIGS. 1 to 11 and 15) and the connecting element 104 preferably comprises setting holes 115 staggered along the length of the connecting element 104 (i.e. between the opposite longitudinal ends 104*a*, 104*b* of the connecting element 104). The setting holes 115 are each configured to receive the stud 114, notably by insertion of the stud 114 into said setting hole 115. Thus, the coupling configuration of the setting means 105 is implemented when the stud 114 is inserted into any of the setting holes 115.

Notably, the crampon 100 can have as many possible length settings as there are setting holes 115. The coupling configuration of the setting means 105 can then be implemented at different setting positions 106 along the connecting element 104. Thus, for example, in FIGS. 5, 7, 9 and 11, it is possible to count eleven setting holes 115, this number being not limitative.

Preferably, what applies to all or part of the setting holes 115 can apply to each setting hole 115.

All or some of the setting holes may be through holes, each passing through the connecting element 104 depending on its thickness.

Alternatively, all or part of the setting holes 115 may be blind and each have an access opening provided on the side of the setting means 105 to authorize insertion of the stud 114.

Preferably, the pitch used for the repetition of the setting holes 115 on the connecting element 104 is 6.4 millimeters.

According to an embodiment making it possible to implement the automatic transition from the coupling configuration of the setting means 105 to the uncoupling configuration of the setting means 105, the stud 114 preferably comprises a sliding surface 116 (for example as visible in FIGS. 4, 5, 7, 9 and 11) configured to, when the locking device 107 is in the unlocking configuration and the setting means 105 are in the coupling configuration of the setting means 105, slide on the connecting element 104 when said force F1 is exerted in order to make it possible to extract the stud 114 from the setting hole 115 in which it is inserted, resulting in the transition from the coupling configuration of the setting means 105 (the stud 114 is inserted into one of the setting holes 115) to the uncoupling configuration of the setting means 105 (the stud 114 is outside each of the setting holes 115). This is notably illustrated by the transition from FIG. 9 to FIG. 11.

The extraction is then done by sliding, gradually causing the stud 114 to exit the setting hole 115 in which it is inserted until the stud 114 is no longer present in said setting hole 115 (FIG. 11).

Different shapes of stud 114 and setting holes 115 can be envisaged as long as extraction by sliding is possible.

Preferably, in the coupling configuration of the setting means 105 and while the locking device 107 is in the unlocking configuration, the sliding surface 116 comes into contact with an edge of the corresponding setting hole 115, at least when the force F1 is initiated, to facilitate the exit of the stud 114 from this setting hole 115 when the force F1 is exerted.

In fact, when the setting means 105 are in the coupling configuration, the stud 114 may have a functional play with the setting hole 115 in which it is inserted. Therefore, the relative bringing closer of the first and second parts 101, 103 allows, if necessary, contact of the sliding surface 116 with the edge of the corresponding setting hole 115, then sliding of the sliding surface 116 against this edge of the corresponding setting hole 115.

Alternatively, in the coupling configuration of the setting means 105, the sliding surface 116 is held in contact with the edge of the corresponding setting hole 115.

All or part of the setting holes 115 may each comprise a chamfer intended to cooperate with the sliding surface 116.

According to an embodiment which is notably illustrated in FIGS. 4, 5, 7, 9 and 11, the sliding surface 116 can be a flat oblique face and each setting hole 115 comprises the edge comprising, on the side of the second part 103, a straight portion 117 (FIGS. 3, 5, 6, 7, 8, 9, 10 and 11) capable of cooperating with the oblique face. The aforementioned cooperation makes it possible to guide the sliding of the oblique face against the edge at the straight portion 117.

The remainder of the edge of each setting hole 115 may connect both opposite longitudinal ends of the straight portion 117 of this edge, for example in the manner of an arc.

The edge of each setting hole 115 notably delimits the access opening of this setting hole 115 through which the stud 114 can enter into said setting hole 115 or the stud 114 can exit from said setting hole 115. This access opening is notably arranged on the upper side of the crampon 100.

Alternatively, it is possible to imagine that the sliding surface 116 corresponds to a spherical surface portion, and that the portion 117 of the edge of the setting hole 115 allowing sliding is arched and is, for example, in the form of an arc of a circle.

In order to participate in the automation of the adjustment of the length setting of the crampon 100, the setting means 105 may comprise a body 118 secured to the frame 102 of the first part 101. The body 118 has, in the coupling configuration of the setting means 105, an original state and being configured to, in the unlocking configuration of the locking device 107:

have an elastic deformation (for example on the upper side of the crampon) when transitioning from the coupling configuration of the setting means 105 to the uncoupling configuration of the setting means 105 (see FIGS. 10 and 11);

transition, by automatic return to the original state, from the uncoupling configuration of the setting means 105 to the coupling configuration of the setting means 105, this being for example the case when the stud 114 reaches another setting hole 115 in the sense that the stud 114 is then no longer in contact with the connecting element 104 in a manner making it possible to retain the elastic deformation.

For example, this transition by automatic return to the original state is allowed in the sense that the body 118, when it is elastically deformed, tends to resume a primitive shape notably corresponding to its shape in the original state when it is no longer biased.

Furthermore, the aforementioned elastic deformation and automatic return make it possible to ensure that the coupling configuration is maintained as long as sufficient force to overcome the spring effect of the body 118 allowing it to be deformed is not implemented (i.e. in this case there is no transition from the coupling configuration to the uncoupling configuration).

Preferably, it is the sliding of the sliding surface 116 against the edge of the corresponding setting hole 115 which induces the elastic deformation of the body 118.

For example, after extraction of the stud 114 from the setting hole 115 in which it was inserted, the stud 114 is supported on a portion 119 of the connecting element 104 (FIG. 11) between two adjacent setting holes 115*a*, 115*b* so that the elastic deformation of the body 118 is maintained, the force F1 leads to having a relative sliding between the stud 114 and the portion 119 of the connecting element 104 until the stud 114 reaches the next setting hole 115*b* into which it automatically enters due to the automatic return mentioned above.

Preferably, in the case of an attempt to move the first and second parts 101, 103 away from each other, the stud 114 abuts, in the coupling configuration, against the corresponding setting hole 115 in such a way that the forces are not taken up by the body 118 which cannot then automatically deform in a way causing the stud 114 to exit the setting hole 115 in which it is inserted.

By "the body 118 secured to the frame 102 of the first part 101", it should be understood that the body 118 can be fastened to the frame 102 of the first part 101, for example by rivet, by bolt, by welding or by crimping or can be integral with the frame 102 of the first part 101. In the example illustrated in FIGS. 1 to 11, a rivet 138 passing through the body 118 and the frame 102 of the first part 101 ensures the fastening of the frame 102 of the first part 101 to the body 118.

Notably, the body 118 is secured/linked to the frame 102 of the first part 101 at a linking region 125 between the body 118 and the frame 102 of the first part 101.

The body 118 may be made of a material that allows said body 118 to deform in a spring-like manner (elastic deformation) allowing it to be biased towards its initial shape when deformed. For example, the material may be metal, steel, carbon, a chromium-molybdenum alloy, or stainless steel.

As illustrated in FIGS. 1 and 2, the body 118 can adopt an elongated shape, for example a frame shape, and the stud 114 can be fastened to this body 118 at a distance from the linking region 125. The elastic deformation of the body 118 takes place notably between the linking region 125 and the stud 114.

Thus, more generally, the body 118 can be configured so as to, during the relative displacement between the first part 101 and the connecting element 104 having induced the automatic transition from the coupling configuration of the setting means 105 to the uncoupling configuration of the setting means 105, allow an automatic transition from the uncoupling configuration of the setting means 105 to the coupling configuration of the setting means 105, from which it results that the newly obtained length setting of the crampon corresponds to a reduction in the length of the crampon 100, that is to say corresponds to a value of the length of the crampon 100 less than the value of the length of the crampon 100 for the previous length setting of the crampon 100.

For example, as visible in FIGS. 1 to 11 and 15, the locking device 107 may comprise a locking element 120 having a mobility ability relative to the frame 102 and the setting means 105. For example, the locking element 120 is configured to vary, according to its mobility ability, between:

- a first configuration in which, in the coupling configuration of the setting means 105, the locking element 120 opposes the transition from the coupling configuration of the setting means 105 to the uncoupling configuration of the setting means 105;
- a second configuration in which the transition from the coupling configuration of the setting means 105 to the uncoupling configuration of the setting means 105 is authorized.

The first configuration may be a first position (FIGS. 1 to 7 and 15) and the second configuration may be a second position (FIGS. 8 to 11). Thus, the variation in position of the locking element 120, preferably provided manually by the user, selectively makes it possible to inhibit or authorize the adjustment of the length setting of the crampon 100.

The locking element 120 makes it possible to make the function of maintaining the locking configuration of the locking device 107 independent.

Besides the fact that this makes it possible to retain the length setting of the crampon 100 during its use, this solution comprising the locking element 120 also makes it possible to retain this setting, for example when the crampon 100 is handled, notably when storing it in a bag after or before use, and when it is deliberately desired to retain the length setting of the crampon and therefore avoid an untimely loss of the current length setting. In addition, even if the stud 114 coupled in a corresponding setting hole 115 can be coupled in such a way that the elongation of the crampon 100 is not authorized without force on the body 118, the locking element 120 can act as an additional safety device.

The locking element 120 may also have a visual indicator function for the state of the crampon 100, for example via its identifiable position, notably so as to indicate whether the latter is such that the coupling configuration can be maintained or not regardless of the force applied to the body 118.

In other words, more generally, the ability to move of the locking element 120 allows said locking element 120 to selectively:

- oppose the transition from the coupling configuration of the setting means 105 to the uncoupling configuration of the setting means 105 (FIGS. 1 to 7 and 15);
- authorize the transition between the coupling configuration of the setting means 105 and the uncoupling configuration of the setting means 105 (FIGS. 8 to 11).

When the locking element 120 is in the/its first configuration and the setting means 105 are in the coupling configuration, the locking element 120 can cooperate with the connecting element 104 to hold the setting means 105, and more particularly the body 118 of the setting means 105, so as to oppose the transition from the coupling configuration of the setting means 105 to the uncoupling configuration of the setting means 105.

This holding naturally prevents the uncoupling of the setting means 105 relative to the connecting element 104.

Thus, the locking element 120 can hold the connecting element 104 and the body 118 together so as to oppose the elastic deformation of the body 118 in the sense that the connecting element 104 is not deformable as is the body 118.

According to an exemplary embodiment, notably as illustrated in FIGS. 1 to 11 and 15, the locking element 120 is a ring and the body 118 is linked to the frame 102 of the first part 101 at the linking region 125, for example the body 118 is fastened to the frame 102 of the first part 101 as described above. The ring is then crossed by the body 118 and slidably mounted relative to, and notably on, the body 118. In the first configuration of the locking element 120, while the setting means 105 are in the coupling configuration, the ring surrounds a part of the connecting element 104 in order to prevent a separation of at least one part of the body 118 relative to the connecting element 104, this separation being that allowing the transition from the coupling configuration of the setting means 105 to the uncoupling configuration of the setting means 105. In the second configuration of the locking element 120, the ring does not oppose the elastic deformation of the body 118 allowing the transition from the coupling configuration of the setting means 105 to the uncoupling configuration of the setting means 105. In other words, in the second configuration of the locking element 120, the ring is positioned so as to authorize/allow the elastic deformation of the body 118 allowing the transition from the coupling configuration of the setting means 105 to the uncoupling configuration of the setting means 105.

Preferably, in the second position of the locking element 120, the ring is closer to the linking region 125 than in the first position of the locking element 120.

The ring can take the form of an open or closed annulus.

According to this exemplary embodiment where the locking element 120 is a ring, it is clear that it is notably the position of the ring which is important for selectively implementing the locking configuration of the locking device 107 or the unlocking configuration of the locking device 107. Here, the first configuration of the locking element 120 therefore corresponds to the first position of the locking element 120 and the second configuration of the locking element 120 corresponds to the second position of the locking element 120.

According to a non-illustrated embodiment, the locking element may, notably when it opposes the transition from the coupling configuration of the setting means to the uncoupling configuration of the setting means, oppose the elastic deformation of the body allowing this transition, for example by being positioned so that at least one part of the body is arranged between the frame of the first part and the locking element. The locking element may for this purpose be in the form of a mechanism rotatably mounted on the frame of the first part and which may have a rotary arm being:

- positioned above the body in the locking configuration of the locking device so as to form a stop preventing a deformation of the body sufficient for the transition from the coupling configuration of the setting means to the uncoupling configuration of the setting means;

positioned away from the body in the unlocking configuration of the locking device so as not to oppose the deformation of the body when the force F1 is applied to the crampon.

It follows from what has been described above that the configuration, and notably the position, of the locking element 120 could condition the possibility of adjusting the length setting of the crampon 100. In order to ensure that the locking configuration of the locking device 107 can be maintained while avoiding an unwanted transition to the unlocking configuration of the locking device 107, the locking device 107 may comprise a blocking member 121 configured to adopt, notably in the locking configuration of the locking device 107, selectively:

- a first configuration in which the blocking member 121 opposes the transition from the first configuration of the locking element 120 to the second configuration of the locking element 120;
- a second configuration in which the blocking member 121 authorizes the transition from the first configuration of the locking element 120 to the second configuration of the locking element 120

Notably, the blocking member 121 is configured so that when the crampon 100 is mounted on the shoe, it is impossible to authorize the variation of the locking element 120 between its first and second configurations, notably because the blocking member 121 is not, in this case, manually accessible.

Notably, in the second configuration of the blocking member 121, the locking element 120 can vary between its first and second configurations, for example by manual actuation by the user, if necessary, by moving it towards the linking region 125 or by moving it away from the linking region 125.

The blocking member 121, as notably illustrated in FIGS. 1 to 11 and 15, may be a spring leaf. In this case, the second configuration of the blocking member 121 corresponds to a compression state of the spring leaf. This compression state may be obtained by manual actuation (in particular in order to transition from the first configuration of the locking element 120 to the second configuration of the locking element 120), for example by manually pushing on the spring leaf, for example via a finger of the user of the crampon 100, and according to a thrust force F2 illustrated in FIG. 7 by an arrow F2. Notably, when the locking element 120 returns from its second configuration to its first configuration, a force applied manually to the locking element 120 is sufficient for the locking element 120 to compress the spring leaf to a tipping point where the spring leaf is no longer compressed (it returns to its original shape), or is less compressed, by the locking element 120 then in its first configuration.

Figure 6:
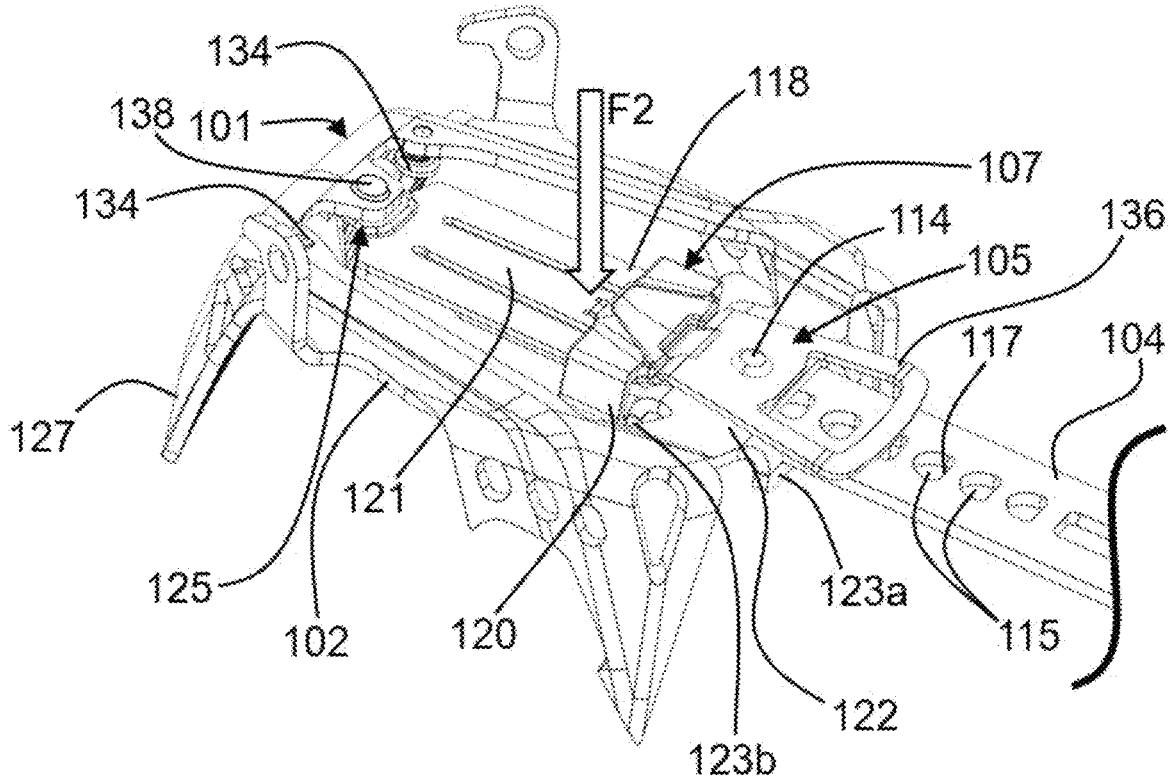
FIG. 6 represents a perspective view of the part of the crampon centered on the back part of the crampon for which a support is provided on a blocking member belonging to the locking device in order to move a locking member belonging to the locking device.
Figure 7:
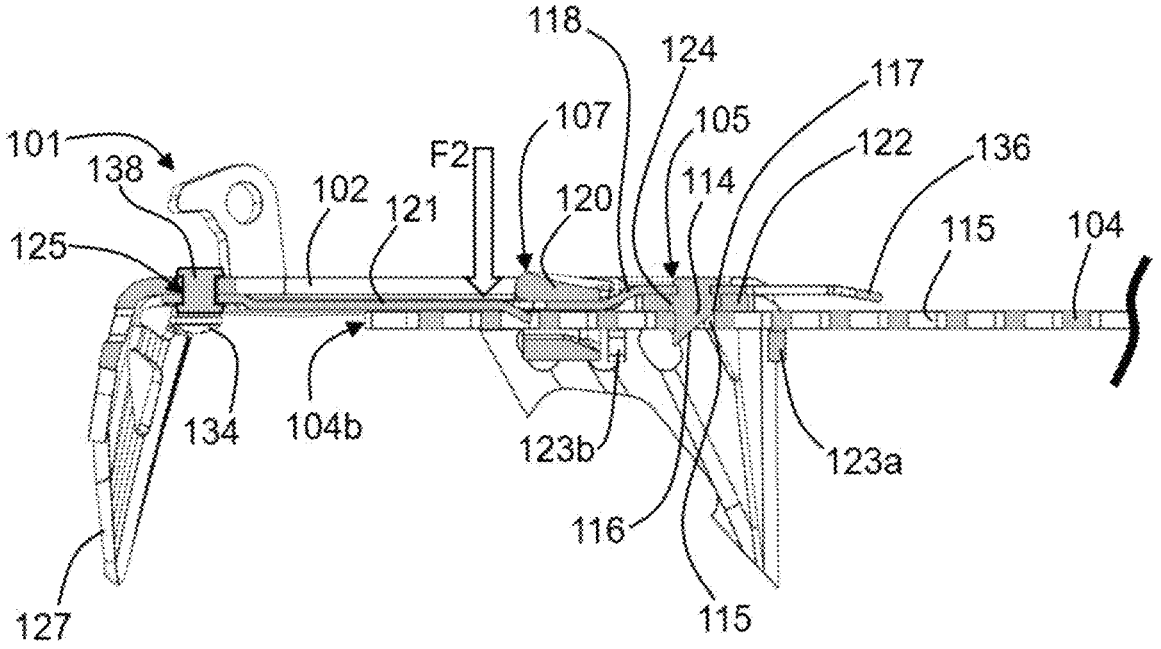
FIG. 7 represents, in a side sectional view, the part of the crampon of FIG. 6.
Figure 8:
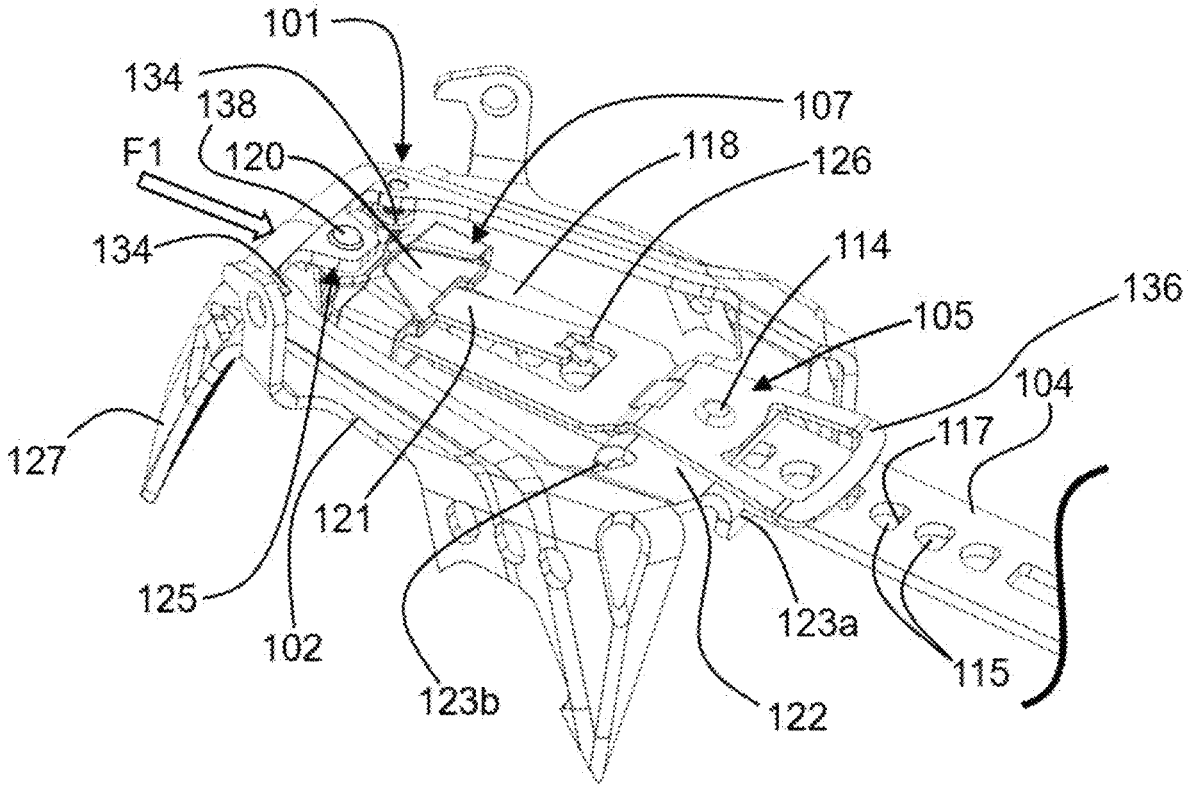
FIG. 8 represents, in a perspective view, the part of the crampon centered on the back part of the crampon for which the locking device no longer locks the setting means.
Figure 9:
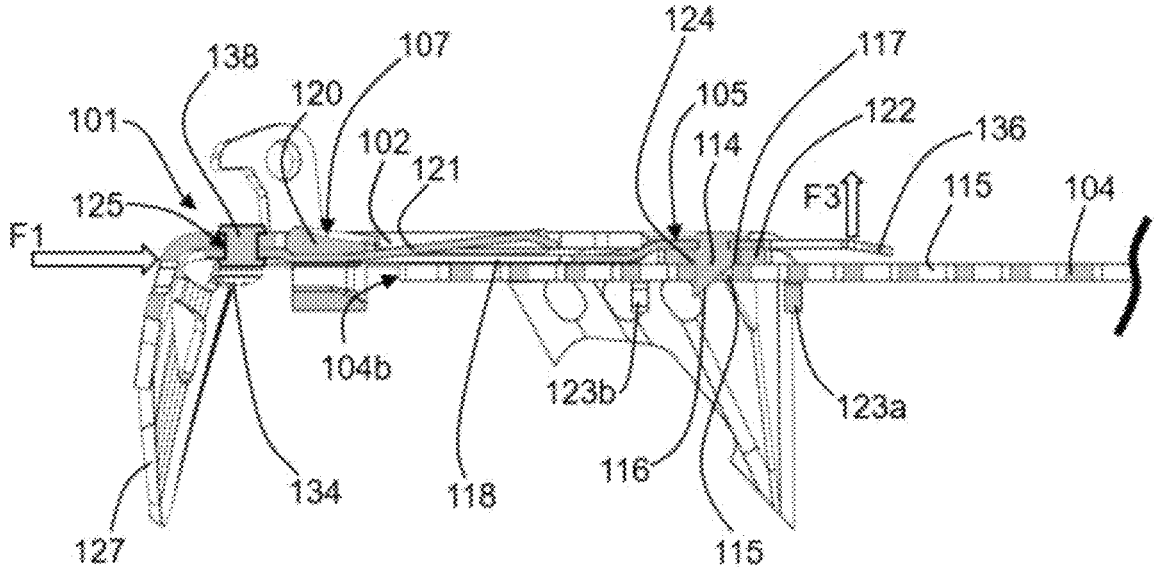
FIG. 9 represents, in a side sectional view, the part of the crampon of FIG. 8.

Preferably, the spring leaf is configured to vary between a first state and a second state, the transition from the first state to the second state being accompanied by a compression of the spring leaf. FIGS. 1 to 3, 5, 10 to 11 and 15 illustrate the first state. FIGS. 6 and 7 illustrate the second state.

Notably, in the first configuration of the blocking member 121, while the locking element 120 is in its first configuration, the spring leaf is in its first state and forms a stop 126 (for example as visible in FIG. 5) opposing the transition of the locking element 120 from its first configuration to its second configuration. For example, in FIG. 5, the spring leaf prevents the ring from moving back towards the linking region 125, which makes it possible to ensure, via the ring, the holding of the body 118 and the connecting element 104 relative to each other. Furthermore, the body 118 can, opposite the linking region 125, widen so as to form an additional stop participating, with the stop 126 formed by the blocking member 121, in holding the ring in a suitable region from which it results that the locking element 120 is held in its first position.

Furthermore, the crampon 100 can be configured so that the transition of the locking element 120 from its first configuration to its second configuration is authorized following the transition of the spring leaf from its first state to its second state, for example induced by the thrust force F2 exerted on the spring leaf by the user of the crampon 100.

In the second state of the spring leaf, the ring can slide along the body 118, notably between the linking region 125 and the stud 114.

For example, as notably illustrated in FIGS. 3 to 11, the frame 102 of the first part 101 comprises a cross member 122 and at least one guide element 123*a*, 123*b* extending from the cross member 122 of the frame 102 of the first part 101, notably on the lower side of the crampon 100. The connecting element 104 cooperates with said at least one guide element 123*a*, 123*b* so as to guide the ability to move.

For example, the presence of two guide elements 123*a*, 123*b* is preferred to form, with the connecting element 104, a sliding connection, thus conditioning the relative movement between the first part 101 and the connecting element 104, and therefore the ability to move.

Of course, a single guide element 123*a*, 123*b* can also be provided if its dimensioning makes it possible to obtain the desired guidance of the connecting element 104 relative to the first part 101, i.e. preferably according to a sliding connection.

In FIGS. 3 to 11, the cross member 122 of the first part 101 comprises a guide element 123*a* forming a stirrup crossed by the connecting element 104 and a guide element 123*b* formed by two support shoulders/hooks supporting the connecting element 104 under the cross member 122 of the frame 102 of the first part 101, both guide elements 123*a*, 123*b* being offset transversely relative to the cross member 122 of the first part 101 and along the connecting element 104.

The cross member 122 of the frame 102 of the first part 101 may comprise an orifice 124 in which the stud 114 is constantly inserted, said cross member 122 being arranged between a portion of the setting means 105, notably from which the stud 114 extends, and a portion of the connecting element 104. Of course, the portion of the connecting element 104 is not the same depending on the current length setting of the crampon 100.

The setting means 105 may comprise a gripping member 136. This gripping member 136 makes it possible, when the locking device 107 is in the unlocking configuration, for example to manually uncouple the setting means 105 from the connecting element 104 (transition from the coupling configuration of the setting means 105 to the uncoupling configuration of the setting means 105) via a tensile force F3 (represented by an arrow F3 in FIG. 9) then authorizing an elongation of the crampon 100, for example by moving the first and second parts 101, 103 apart or even a shortening of the crampon 100 by bringing closer the first and second parts 101, 103. The gripping member 136 is notably a part of the body 118 forming an end of the body 118 distal to the linking region 125. The gripping member 136 can form the additional stop mentioned above. The elastic deformation of the body 118, allowing the extraction of the stud 114 from the setting hole 115 in which it is inserted, notably takes place between the linking region 125 and the gripping member 136.

Conventionally, the first part 101 and the second part 103 each comprise spikes 127, 128, notably arranged on the lower side of the crampon 100, and extending from the corresponding frame 102, 110.

Figure 4:
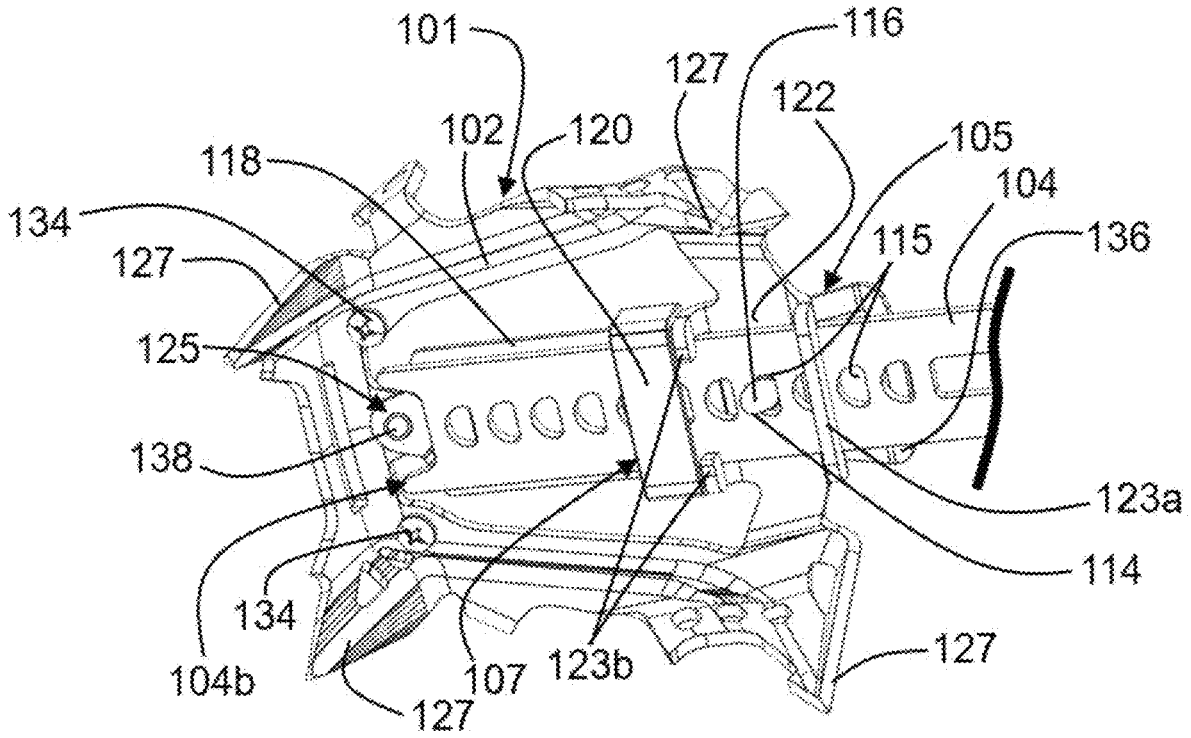
FIG. 4 represents a bottom view of the part of the crampon of FIG. 3.

The spikes 127 of the first part 101 may be integral with the frame 102 of the first part 101, and may be four in number as illustrated in FIG. 4.

The frame 102 of the first part 101 may be made of steel or aluminum.

Figure 13:
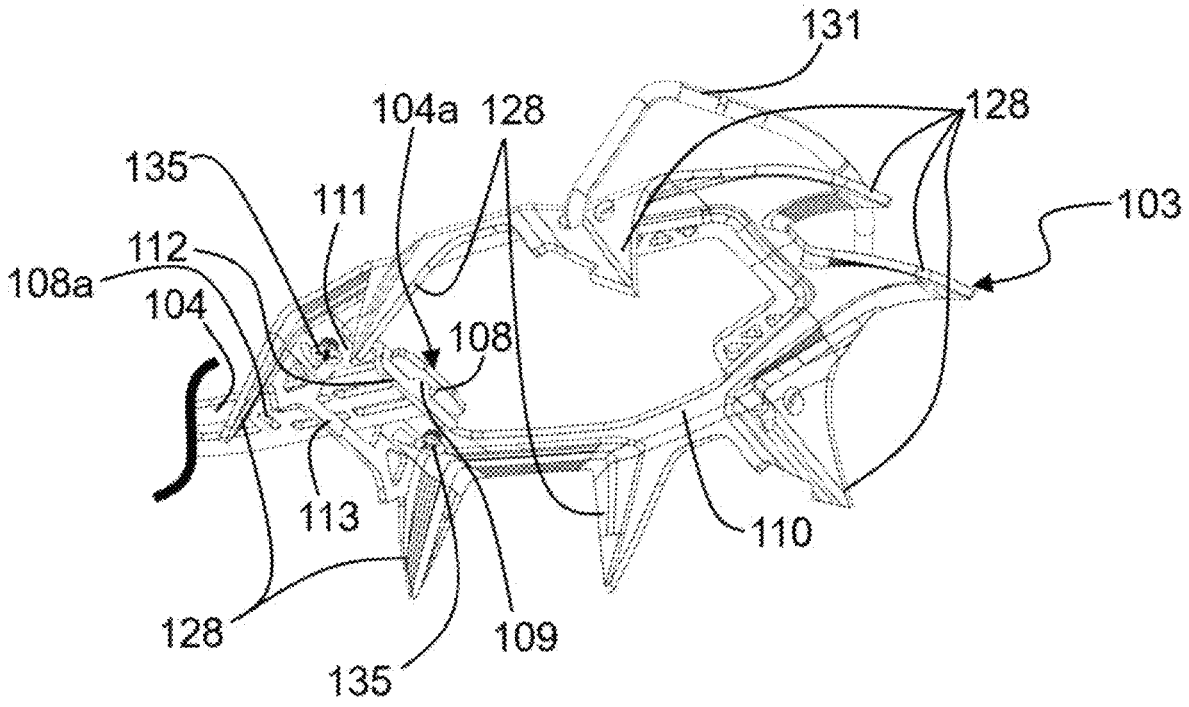
FIG. 13 represents, in a perspective view, a bottom view of the other part of the crampon of FIG. 12.

The spikes 128 of the second part 103 may be integral with the frame 110 of the second part 103, and may be eight in number as illustrated in FIG. 13.

The frame 110 of the second part 103 may be made of steel or aluminum.

In the technical field of the invention, the frame 102 of the first part 101 and the spikes 127 of the first part 101 can be an integral part of an assembly called a rail (back rail in the case illustrated in FIG. 1).

In the technical field of the invention, the frame 110 of the second part 103 and the spikes 128 of the second part 103 can be an integral part of an assembly called a rail (front rail in the case illustrated in FIG. 1).

As shown in FIGS. 1 to 2, the crampon 100 may comprise an attachment system for the shoe. Notably, the attachment system may comprise:

- a back fastener 129 secured to the first part 101 and configured to snap onto a heel welt of the shoe, the back fastener 129 being able to comprise a tightening strap 130 for clamping the shoe between the back of the shoe and a portion of an upper of the shoe located above an instep of the shoe;
- a front fastener 131 configured to engage on a toe welt of the shoe.

Alternatively, simple strips may be used to secure the first part 101 to the back of the shoe and the second part 103 to the front of the shoe.

Thus, any attachment system making it possible to carry out the function of securing the shoe respectively to the first part 101 and to the second part 103 can be provided.

It should be noted that in FIGS. 3 to 11, the back fastener 129 of the attachment system has been removed for clarity.

Figure 15:
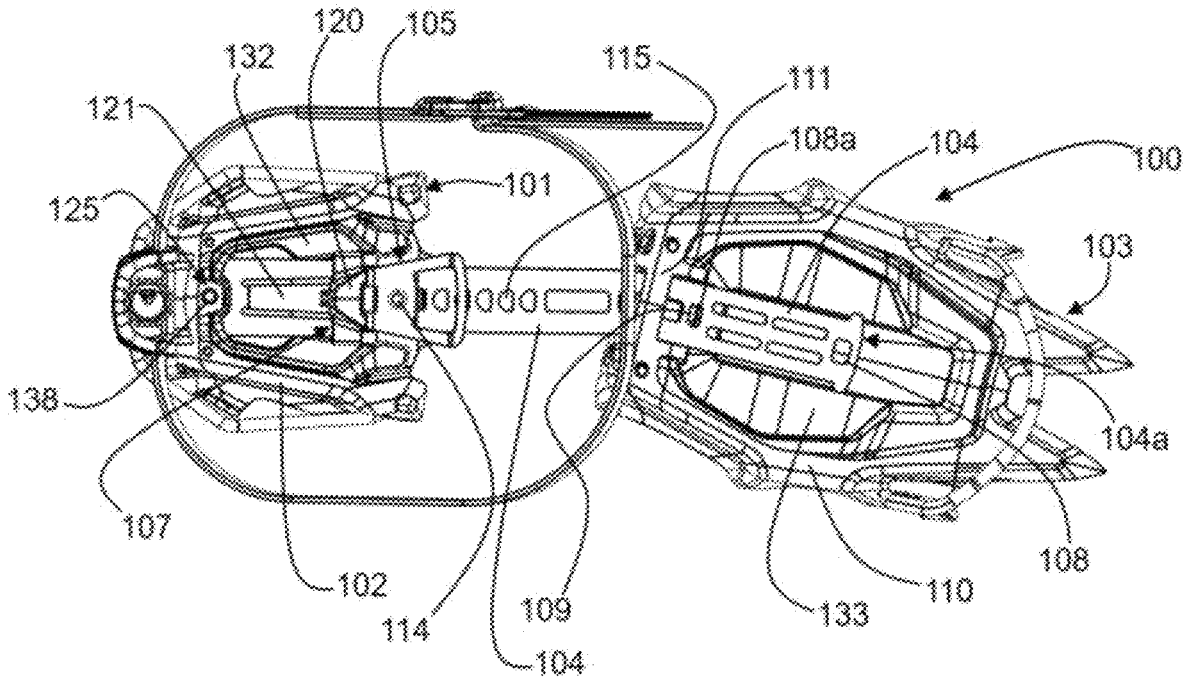
FIG. 15 represents a top view of the crampon in a use configuration for a length setting adjustment suitable for a small foot as opposed to a use configuration for a length setting adjustment suitable for a large foot of FIGS. 1 and 2.

FIGS. 1, 2 and 15 show anti-snow accessories 132, 133, notably back and front respectively. These anti-snow accessories 132, 133 are in fact membranes that completely or partially seal the frame 102 of the first part 101 and the frame 110 of the second part 103 in order to prevent the accumulation of snow stuck under the shoe when using the crampon 100.

These anti-snow accessories 132, 133 are optional, they have moreover been removed in FIGS. 3 to 14 where screws 134, 135 used to fasten them respectively to the frame 102 of the first part 101 and to the frame 110 of the second part 103, if necessary, are nevertheless still visible.

Besides its function of preventing the accumulation of snow in front of the crampon 100, i.e. under the second part 103 in the example illustrated in FIGS. 1, 2 and 15, the front anti-snow accessory 133 can ensure, if necessary, that the coupling between the first and second coupling members 108, 109 is maintained, for example by exerting a force on the connecting element 104 tending to oppose the previously mentioned tilting making it possible to carry out the uncoupling of the first and second coupling members 108, 109. The aforementioned force on the connecting element 104 may be a spring effect applied locally by the front anti-snow accessory 133, this spring effect being able to be overcome by deformation of the front anti-snow accessory 133 when a force is voluntarily applied by the user to the connecting element 104 and/or to the second part 103 in order to misalign them to obtain the desired tilt necessary for uncoupling the first and second coupling members 108, 109.

According to a particular embodiment, which is notably illustrated in FIGS. 1, 2 and 12 to 15, the connecting element 104 may comprise a first additional coupling member **108*a*, the first additional coupling member 108*a* and the first coupling member 108 being offset along the connecting element 104. In this case, all that has been described in relation to the first coupling member 108 and the second coupling member 109 may apply to the first additional coupling member 108*a* and to the second coupling member 109. Thus, the crampon 100 may have two use configurations respectively coupling the second coupling member 109 to the first coupling member 108 and the second coupling member 109 to the first additional coupling member 108*a*. FIGS. 1 and 2 show the first coupling member 108 coupled with the second coupling member 109 (typically corresponding to a use configuration for large feet), and FIG. 15 shows the first additional coupling member 108*a* coupled with the second coupling member 109 (typically corresponding to a use configuration for small feet compared to the large feet for FIGS. 1 and 2). This has, in a given use configuration, an influence on the adjustment range of the length setting of the crampon 100 by cooperation between the setting means 105 and the connecting element 104**.

The first part 101 and the second part 103 notably form a support platform for the shoe on the upper side of the crampon 100. The front fastener 131 may form a front stop for the shoe. The first back part 101 may comprise one or several back stops 137 for the shoe.

Of course, the invention also relates to a pair of crampons as described respectively for equipping a right shoe and a left shoe. It should be noted that the crampon 100 of FIGS. 1 and 2 is intended to equip a left shoe.

The present invention finds an industrial application in the field of practicing activities in the mountains and/or on icy or snow-covered surface.

The invention claimed is:

1. A length-adjustable crampon for a shoe, the length-adjustable crampon comprising:

- a first part comprising a frame;
- a second part;
- an elongated connecting element connecting the first and second parts, the first part and the elongated connecting element being configured to have relative to each other an ability to move along a length of the elongated connecting element to allow an adjustment of a length setting of the length-adjustable crampon;
- setting means configured to selectively adopt:
- a coupling configuration with the elongated connecting element ensuring the length setting of the length-adjustable crampon;
- an uncoupling configuration relative to the elongated connecting element in which the ability to move is authorized in order to ensure the adjustment;
- a locking device configured to selectively adopt:
  - a locking configuration in which, when the setting means are in the coupling configuration, the locking device prevents a transition from the coupling configuration to the uncoupling configuration to maintain the length setting of the length-adjustable crampon;

an unlocking configuration in which variation between the coupling configuration and the uncoupling configuration is authorized;

the length-adjustable crampon being configured so that, when the locking device is in its unlocking configuration and the setting means are in the coupling configuration, a force exerted on the length-adjustable crampon induces an automatic transition from the coupling configuration to the uncoupling configuration, the force being exerted on the length-adjustable crampon to obtain a relative displacement between the first part and the elongated connecting element according to the ability to move in order to adjust the length setting of the length-adjustable crampon by reducing the length of the length-adjustable crampon.

2. The length-adjustable crampon according to claim 1, wherein one of the first and second parts is a front part intended to receive a front of a sole of the shoe, and the other of the first and second parts is a back part intended to receive a back of the sole of the shoe.

3. The length-adjustable crampon according to claim 1, wherein the setting means comprise a stud, and wherein the elongated connecting element comprises setting holes staggered along the length of the elongated connecting element and each configured to receive the stud, the coupling configuration being implemented when the stud is inserted into any of the setting holes.

4. The length-adjustable crampon according to claim 3, wherein the stud comprises a sliding surface configured to, when the locking device is in the unlocking configuration and the setting means are in the coupling configuration, slide on the elongated connecting element when the force is exerted in order to make it possible to extract the stud from a respective setting hole in which it is inserted, resulting in the transition from the coupling configuration to the uncoupling configuration.

5. The length-adjustable crampon according to claim 4, wherein the sliding surface is a flat oblique face and wherein each setting hole comprises an edge comprising, on a side of the second part, a straight portion capable of cooperating with the flat oblique face.

6. The length-adjustable crampon according to claim 1, wherein the setting means comprise a body secured to the frame of the first part, the body having, in the coupling configuration, an original state and being configured to, in the unlocking configuration of the locking device:

have an elastic deformation when transitioning from the coupling configuration to the uncoupling configuration;

transition, by automatic return to the original state, from the uncoupling configuration to the coupling configuration.

7. The length-adjustable crampon according to claim 6, wherein the body is configured so as to, upon relative displacement between the first part and the elongated connecting element having induced the automatic transition from the coupling configuration to the uncoupling configuration, allow an automatic transition from the uncoupling configuration to the coupling configuration, from which it results that a newly obtained length setting of the length-adjustable crampon corresponds to a reduction in the length of the length-adjustable crampon.

8. The length-adjustable crampon according to claim 6, wherein the locking device comprises a locking element having a mobility ability relative to the frame and to the setting means, the locking element being configured to vary, according to its mobility ability, between:

a first configuration in which, in the coupling configuration, the locking element opposes the transition from the coupling configuration to the uncoupling configuration;

a second configuration in which the transition from the coupling configuration to the uncoupling configuration is authorized.

9. The length-adjustable crampon according to claim 8, wherein, when the locking element is in the first configuration and the setting means are in the coupling configuration, the locking element cooperates with the elongated connecting element to hold the setting means so as to oppose the transition from the coupling configuration to the uncoupling configuration.

10. The length-adjustable crampon according to claim 9, wherein:

the body is linked to the frame of the first part at a linking region;

the locking element is a ring crossed by the body and slidably mounted relative to the body;

in the first configuration of the locking element, while the setting means are in the coupling configuration, the ring surrounds a part of the elongated connecting element in order to prevent a separation of at least a part of the body relative to the elongated connecting element allowing the transition from the coupling configuration to the uncoupling configuration;

in the second configuration of the locking element, the ring does not oppose the elastic deformation of the body allowing the transition from the coupling configuration to the uncoupling configuration.

11. The length-adjustable crampon according to claim 8, wherein the locking device comprises a blocking member configured to selectively adopt:

a first configuration in which the blocking member opposes the transition of the locking element from its first configuration to its second configuration;

a second configuration in which the blocking member authorizes the transition of the locking element from its first configuration to its second configuration.

12. The length-adjustable crampon according to claim 11, wherein:

the blocking member is a spring leaf;

the second configuration of the blocking member corresponds to a compression state of the spring leaf;

the spring leaf is configured to vary between a first state and a second state, the transition from the first state to the second state being accompanied by a compression of the spring leaf;

in the first configuration of the blocking member, while the locking element is in its first configuration, the spring leaf is in its first state and forms a stop opposing the transition of the locking element from its first configuration to its second configuration;

the length-adjustable crampon is configured so that the transition of the locking element from its first configuration to its second configuration is authorized following the transition of the spring leaf from its first state to its second state.

13. The length-adjustable crampon according to claim 1, wherein the frame of the first part comprises a cross member and at least one guide element extending from the cross member, the elongated connecting element cooperating with the at least one guide element so as to guide the ability to move.

14. The length-adjustable crampon according to claim 1, wherein the length-adjustable crampon comprises a length setting configuration in which the elongated connecting element and the second part are coupled:

so as to have relative to each other a degree of freedom along the elongated connecting element strictly less than a value of the relative displacement between the first part and the elongated connecting element during a variation in the length setting of the length-adjustable crampon between two adjacent setting positions along the elongated connecting element; or so that any relative movement between the elongated connecting element and the second part in a direction along the length of the elongated connecting element is prevented.

* * * * *